US006478846B1

(12) United States Patent
Schmit et al.

(10) Patent No.: US 6,478,846 B1
(45) Date of Patent: Nov. 12, 2002

(54) METHOD AND DEVICE FOR INJECTING REDUCING AGENTS IN A SHAFT FURNACE

(75) Inventors: Louis Schmit, Luxembourg (LU); Raymond Mack, Luxembourg (LU); Karl Langner, Duisberg (DE); Klaus Schott, Dinslaken (DE)

(73) Assignees: Paul Wurth (LU); Thyssen Krupp Stahl AG (DE); Kuettner GmbH & Co. KG (DE)

( * ) Notice: Subject to any disclaimer, the term of this patent is extended or adjusted under 35 U.S.C. 154(b) by 0 days.

(21) Appl. No.: 09/529,057

(22) PCT Filed: Oct. 14, 1998

(86) PCT No.: PCT/EP98/06501

§ 371 (c)(1),
(2), (4) Date: May 11, 2000

(87) PCT Pub. No.: WO99/20800

PCT Pub. Date: Apr. 29, 1999

(30) Foreign Application Priority Data

Oct. 15, 1997 (LU) ..... LU 90 150

(51) Int. Cl.[7] ..... C21B 7/16

(52) U.S. Cl. ..... 75/380; 75/414; 75/460; 266/47; 266/81; 266/85; 266/182

(58) Field of Search ..... 75/380, 414, 460; 266/47, 81, 85, 182

(56) References Cited

U.S. PATENT DOCUMENTS 3,197,304 A * 7/1965 Agarwal
3,966,457 A * 6/1976 Limpach et al. ..... 75/460
4,325,312 A 4/1982 Ulveling et al.
4,373,451 A 2/1983 Gardner et al.
4,570,552 A 2/1986 Rachner et al.
4,702,182 A 10/1987 Ulveling et al.
5,123,632 A * 6/1992 Schmit et al. ..... 266/47
5,451,034 A * 9/1995 Ulveling et al. ..... 75/460

FOREIGN PATENT DOCUMENTS

| | | |
|---|---|---|
| DE | 410 681 | 6/1922 |
| DE | 381 917 | 7/1933 |
| DE | 1 608 382 | 12/1970 |

* cited by examiner

*Primary Examiner*—Melvyn Andrews
(74) *Attorney, Agent, or Firm*—Smith, Gambrell & Russell, L.L.P.

(57) ABSTRACT

The invention relates to a method for injecting reducing agents into a shaft furnace in which the reducing agent is transported within a pneumatic delivery stream to the shaft furnace according to the flowing steps; a) dividing the delivery stream into a number of partial streams, b) transferring the individual partial streams through a heating unit, and c) heating the reducing agent within the individual partial streams inside of the heating device. A device for carrying out the inventive method comprises, for example, a delivery line in order to pneumatically deliver the reducing agent to the shaft furnace, and a number of heat exchange pipes which are integrated in the delivery line using a parallel connection, said connection relating to flow techniques, such that the pneumatic delivery stream is divided into a number of partial streams. The inventive device also comprises a heating unit for transmitting heat energy to the individual partial streams.

24 Claims, 6 Drawing Sheets

METHOD AND DEVICE FOR INJECTING REDUCING AGENTS IN A SHAFT FURNACE

FIELD OF THE INVENTION

Figure 1:
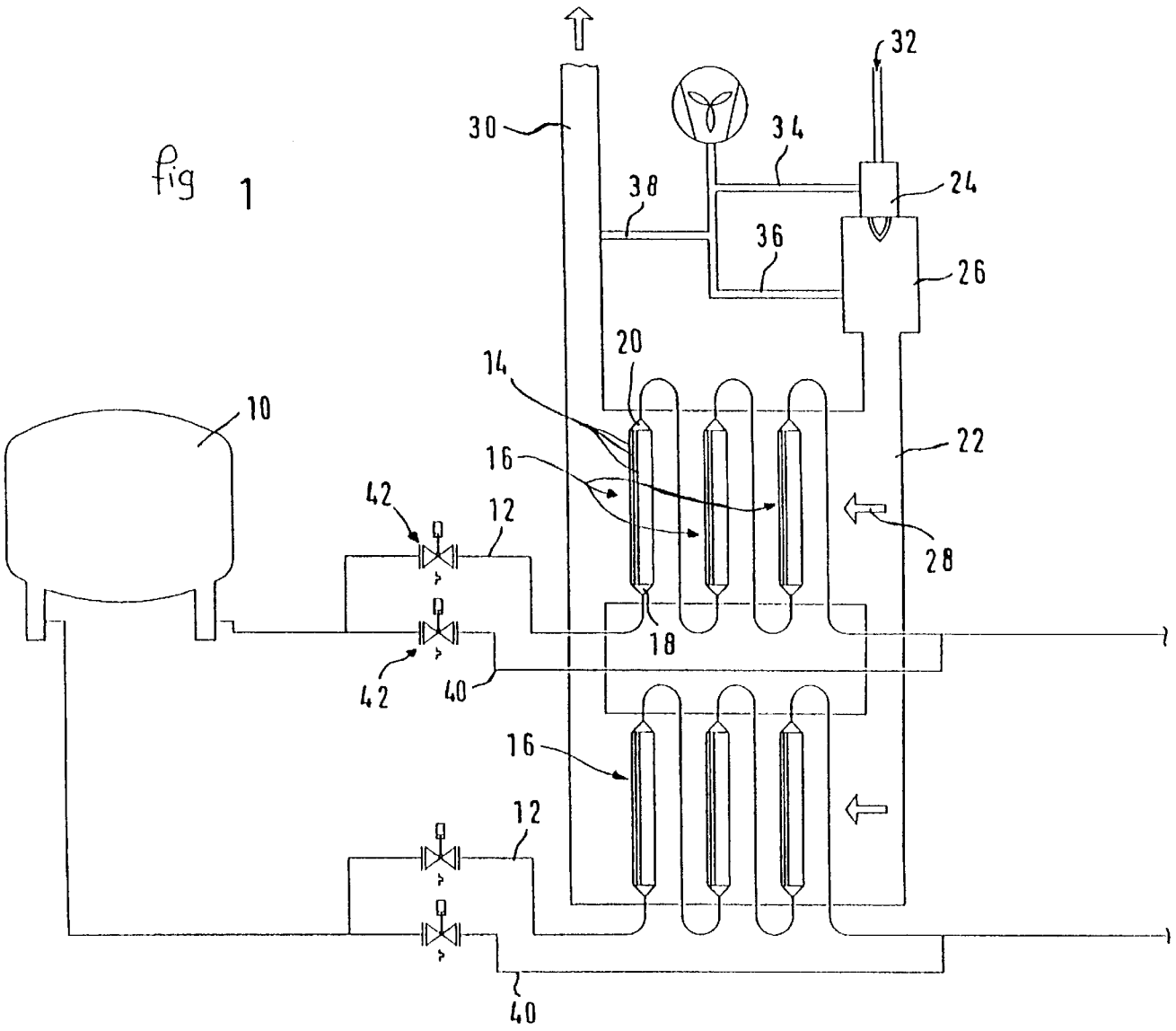

The present invention relates to a device for injection of reducing agents into a shaft furnace, in particular for injection of pulverised coal into a blast furnace during production of pig iron.

To save high-quality reducing agents such as coke in the production of liquid metals in shaft furnaces, a portion of these reducing agents can be replaced by pulverised coal. The pulverised coal is obtained from raw coal in a preparation plant. The raw coal is crushed and dried and subsequently stored temporarily in coal silos. For introduction into the shaft furnace the temporarily stored pulverised coal is loosened, pressurised and injected into the shaft furnace pneumatically by a carrier gas via conveying lines. Injection is generally effected by several injection lances, which terminate in the blast tuyeres of the shaft furnace, so that introduction takes place simultaneously at various points of the shaft-furnace.

To achieve the largest possible saving of reducing agent costs by the injection of pulverised coal, the injected pulverised coal must be converted as completely as possible in the blast tuyere air duct, so that only residual coke need be gasified in the eddy zone. The term "complete conversion" here means that all carbon atoms combine with oxygen, carbon monoxide and/or carbon dioxide being formed. If the conversion in this zone is not complete, which may be the case in particular at high injection rates, conversion residues are concentrated in the shaft furnace, which leads to unstable furnace conditions.

The important causes of the defective pulverised coal conversion in the eddy zone lie firstly in the small dimensions of the actual reaction space and secondly in the high speeds of the media and flow properties of the hot blast air in the tuyere. Within the short time consequently available for the complete conversion of the coal particles at the lance outlet the pulverised coal flow emerging from the lance must be mixed with the hot-blast air, the individual pulverised coal particles must be heated to such an extent that their ignition temperature is achieved,. Released pyrolysis gases must be mixed with the available oxygen, ignite and the solid residue after conclusion of the pyrolysis must enter into an oxidation reaction with any still free or bonded oxygen.

To improve the reaction conditions for the conversion of pulverised coal in the injection zone and thus accelerate the reaction kinetics of the conversion, various measures have been proposed, e.g. increase of the oxygen concentration in the hot blast air, the local increase of the oxygen concentration by simultaneous injection of oxygen via coaxial lances or double lances or the minimisation of the pulverised coal outlet pulse at the tip of the lance by enlargement of the outlet cross-section. Although these measures, some of which are already used, whereas others are only in the testing or optimisation phase, bring about a certain improvement in the reaction conditions, the acceleration of the pulverised coal conversion which is achieved by these measures has proved to be still inadequate.

SUMMARY OF THE INVENTION

Consequently, the task of the present invention is to propose a method and device for injection of coal into a shaft furnace which substantially accelerate the reaction kinetics of pulverised coal conversion, so that the latter begins immediately after the injection and is essentially concluded on entry into the eddy zone.

According to the invention this problem is solved by a method for injection of reducing agents into a shaft furnace according to claim 1 and by a device according to claim 6.

In the method according to the invention, in which a reducing agent such as pulverised coal is conveyed in a pneumatic flow to the blast furnace, the conveying flow is divided into several partial flows, which are led through a heating device, the reducing agent in the individual partial flows being heated inside the heating device by a heat supply. The individual partial flows are subsequently preferably combined into a common conveying flow again for homogenisation of the temperature conditions prior to a possible apportionment. of the conveying flow to the individual injection lances distributed around the shaft furnace.

By heating the pulverised coal inside the heating device heat can be fed to the pulverised coal in a controlled manner, so that its temperature can be set to a value which is favourable for use of the pulverised coal conversion in the shaft furnace. Consequently the pulverised coal preheated in this way needs to absorb significantly less heat from the hot blast air after injection into the shaft furnace in order to achieve its ignition temperature, and its conversion in the shaft furnace clearly starts more quickly than with pulverised coal injected "cold", so that the short available reaction time can be fully utilised for the conversion.

In addition the cooling of the reaction space is reduced by the smaller heat transfer of the hot blast air to the pulverised coal with the result that it can be ensured that the temperature in the entire reaction space remains high enough to permit reduction of the carbon dioxide formed during conversion of the pulverised coal to carbon monoxide. Consequently a further increase in the pulverised coal conversion is achieved, because the oxygen atoms present can bond substantially more carbon atoms. On the other hand the higher carbon monoxide proportion has a highly favourable effect on the operation of the shaft furnace, because it serves as a reducing agent for the actual metal recovery.

In a preferred embodiment the reducing agent is heated in several stages, i.e. subdivision of the conveying flow into several partial flows, conduction of the individual partial flows through a heating device and heating of the reducing agent in the individual partial flows inside the heating device are repeated several times, the individual partial flows between two successive stages being combined into a common delivery flow for homogenisation of the temperature conditions.

To improve the heat transfer to the reducing agent in a partial flow, the latter is preferably made to rotate about its direction of flow. The rotary motion and the associated turbulence in the partial flow produce rearrangement of the material in the partial flow, so that the latter is thoroughly mixed. In addition the velocity of the individual particles in the partial flow and their exchange path length in the heat-exchanger increase. Consequently the heat transfer to the reducing agent in the heat-exchanger can be clearly improved. Hence all partial flows are preferably made to rotate in this way.

Finally cold reducing agent can be fed to the common conveying flow for control of the injection temperature of the reducing agent before the injection into the shaft furnace.

A device according to the invention for injection of reducing agent into a shaft furnace comprises a conveying line for pneumatic conveyance of the reducing agent to the shaft furnace, several heat-exchanger tubes integrated in the conveying line with parallel connection, so that the pneumatic conveying flow is divided into several partial flows, and a heating device for transfer of thermal energy to the individual partial flows. With this device heat can be fed in a controlled manner to the reducing agent during its conveyance between a storage tank and the injection lances on the shaft furnace.

The heating takes place inside the conveying line, i.e. it can be carried out immediately before the injection of the pulverised coal into the shaft furnace. Consequently the pulverised coal is discharged to the consumer immediately after the heating, so that safety problems do not occur during temporary storage of a heated fuel. In addition the heat losses to the environment are very small, not least because of the reduced radiation surfaces.

Subdivision of the pneumatic conveying flow into several partial flows produces the required effective heat transfer surface in an arrangement with small dimensions, i.e. the surface at which heat is transferred to the reducing agent or the respective partial flow. In addition a high coefficient of heat transfer is established in the solid/conveying gas mixture as a result of the turbulent flow and the higher gas density because of the excess conveying pressure.

Consequently the individual partial flows can absorb large quantities of heat in a very short time and over a short distance, so that the length of the heat-exchanger tubes can be kept correspondingly short. The entire device is accordingly characterised by its compact design, which may be highly important, e.g. during conversion of existing plants.

In a preferred embodiment the heating device comprises a heating chamber, which can admit a heat carrier, the heat-exchanger tubes being arranged inside the heating chamber or extending at least partially through the heating chamber. The heat carrier may comprise, for example, a hot gas from a furnace. Direct heat transfer between the hot gas and the solid/conveying gas mixture then takes place. As a result of the high temperature of the hot gas a large mean temperature gradient of hot gas to solid/conveying gas mixture providing the heat exchange can be maintained. In addition a significant heat transfer due to radiation is added to the convective heat transfer on the hot gas side because of the (sometimes) high temperatures in the hot gas, so that an extremely high heat flow density is achieved.

The furnace is preferably operated with weak gas, e.g. blast furnace gas. Consequently unfavourably high combustion temperatures, which would necessitate precooling of the hot gas before entry into the heating chamber during normal operation, are avoided. The high waste gas temperature prevailing behind the heating chamber during operation with a high mean temperature gradient of hot gas to solid/conveying gas mixture does not constitute a significant economic loss if there is no further utilisation of the residual heat of the waste gas.

If the heat-exchanger tubes are not exposed to a conveying gas/solid mixture, e.g. when the hot gas side is started up, the hot gas can be brought to a lower temperature by admixing cold air behind the furnace; the heat-exchanger tubes are thus protected against overheating. The waste gas can be cooled to a permissible discharge temperature in exactly the same way by admixing cold air, if the device is operated with a high mean temperature gradient of hot gas to solid/conveying gas mixture and the waste gas is to be discharged directly into the environment after leaving the heat-exchanger without further utilisation of the residual heat.

Alternatively the heat carrier may comprise a liquid or condensing medium. A liquid heat carrier has a higher specific heat capacity $C_p$ than the gaseous one, so that a larger quantity of heat per volume can be entrained and emitted in this case. A condensing medium, i.e. a medium which undergoes a phase transition during the heat emission, is characterised by high heat emission at a constant temperature. Hence a medium with a condensation temperature coinciding with the required injection temperature of the reducing agent is preferably selected. Consequently overheating of the reducing agent, e.g. if a heat-exchanger tube is blocked, can be largely precluded.

The heat-exchanger tubes are advantageously arranged essentially vertically and are traversed from the bottom upwards by the partial flows. Consequently solid deposits with local overheating of the tubes are avoided, the tube cross-section is exposed to a uniform flow in each case, and the heat transfer from the tube wall to the solid/conveying gas mixture flow is optimised.

In an advantageous embodiment of the device a swirler, which causes the partial flow passing through the respective heat-exchanger tube to rotate about its direction of flow, is arranged in one or more, but preferably in all heat-exchanger tubes. Rotation of the partial flow improves the thorough mixing of the respective partial flow, so that the heat transfer to the partial flow is improved. In addition the velocity of the individual particles in the partial flow as well as their exchange path length in the heat-exchanger increase.

The swirler may, for example, comprise one or more spiral metal strips extending in an axial direction inside the heat-exchanger tube. The pitch of the spiral twist of the respective metal strip can be selected according to the required exchange path length of the reducing agent in the heat-exchanger.

In a preferred embodiment of the invention the heat-exchanger tubes are assembled a certain distance from each other to form a heat-exchanger nest, the latter having on its inlet side a distributor for uniform apportionment of an incoming conveying flow to the individual heat-exchanger tubes and on its outlet side a collector for bringing together the individual partial flows to form an outlet flow. The distributor and the collector are preferably of identical construction so that the direction of installation of the heat-exchanger nests is unimportant. Consequently the heat-exchanger tubes are combined to form easily assembled, standardised units and blocked heat-exchanger nests can easily be changed if required.

In the case of conveying lines with a large cross-section the division of the conveying flow into several partial flows can take place in several stages. The conveying flow is apportioned, for example, via pre-distributors to several heat-exchanger nests. The device accordingly comprises several heat-exchanger nests, the latter preferably being assembled a certain distance from each other to form a heat-exchanger group, the latter having on its inlet side a pre-distributor for uniform apportionment of an incoming conveying flow to the individual heat-exchanger nests and on its outlet side an additional collector for bringing together the individual partial flows to form a common outlet flow. The pre-distributor and the second collector are preferably of identical construction and are, for example, of the type of the particle flow distributor described in U.S. Pat. No. 4,702,182.

BACKGROUND OF THE INVENTION

In a preferred embodiment of the invention several heat-exchanger nests or groups are connected in series. In this way a compact arrangement can be achieved. The solid/conveying gas mixture partial flows are brought together behind each heat-exchanger nest or group, and any different temperature increases that might occur in the individual tubes or tube nests are compensated. The failure of individual tubes or tube nests does not significantly impair the serviceability and exchange capacity of the entire device. In a plant with heat-exchanger groups individual nests can be taken out of service for maintenance or shutdown, as long as shut-off valves are provided.

Guide vanes are advantageously arranged inside the heating chamber in such a way that effective flow of the heat carrier to the heat-exchanger tubes takes place. The guide vanes may, for example, be baffles, which divert the hot gas flow selectively to the individual heat-exchanger nests.

A bypass line, which terminates in the conveying line behind the heat-exchanger tubes when viewed in the direction of the conveying flow, should preferably be provided for each conveying line. This allows the conveyance to be continued smoothly in the event of failure of the heat-exchanger or if heating is dispensed with. The change-over between heat-exchanger and bypass line can be carried out gradually and smoothly, with minimisation of the risk of line blockages, by the use of solid mass flow control valves.

If several solid/conveying gas mixtures are heated in parallel, whereby the total hot gas supply emanates from a furnace, different heating temperatures can be established in the individual solid/conveying gas mixtures with the aid of the solid mass flow control valves.

BRIEF DESCRIPTION OF THE INVENTION

An embodiment of the invention will now be described below with the aid of the enclosed figures.

Figure 2:
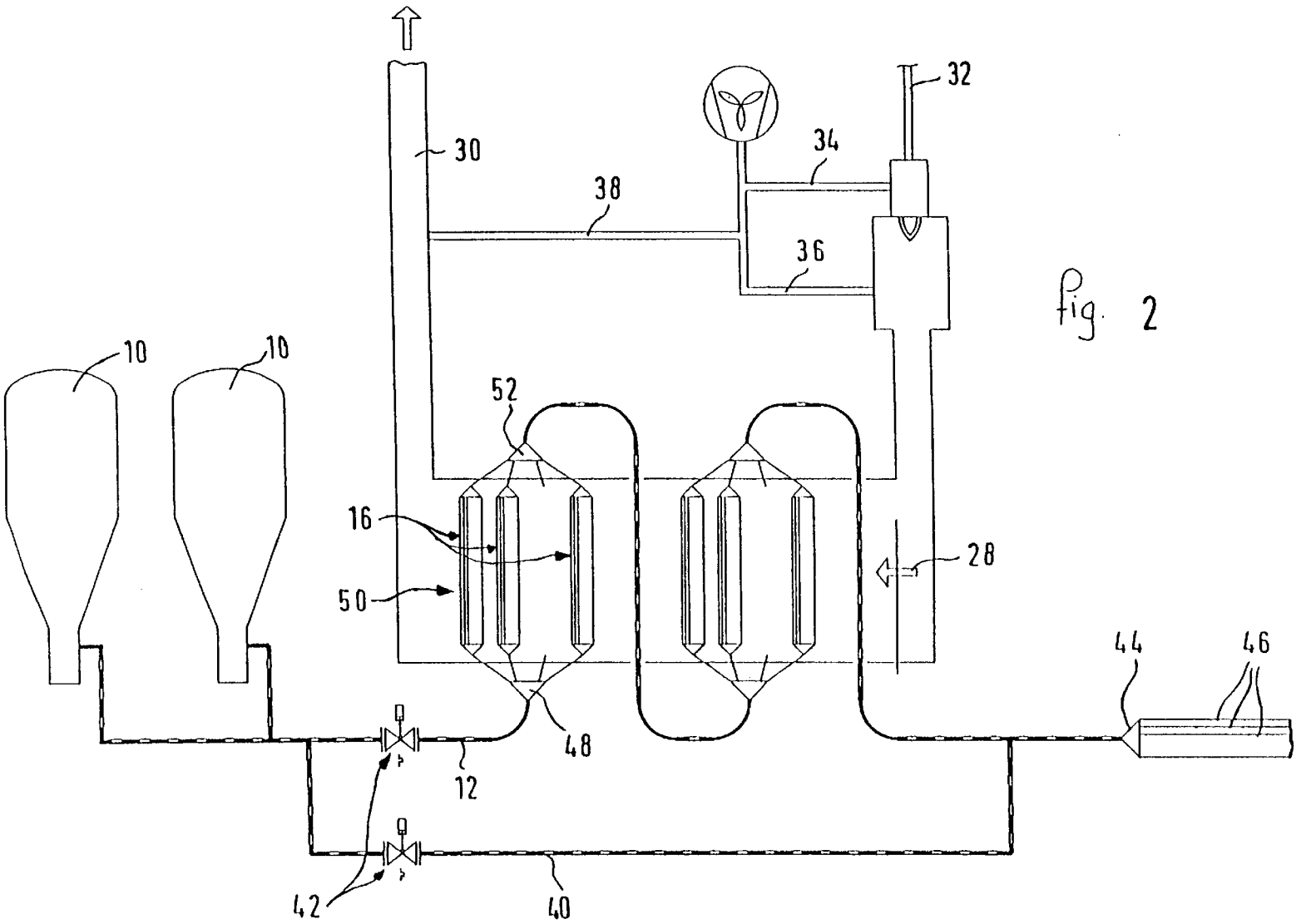
Figure 3:
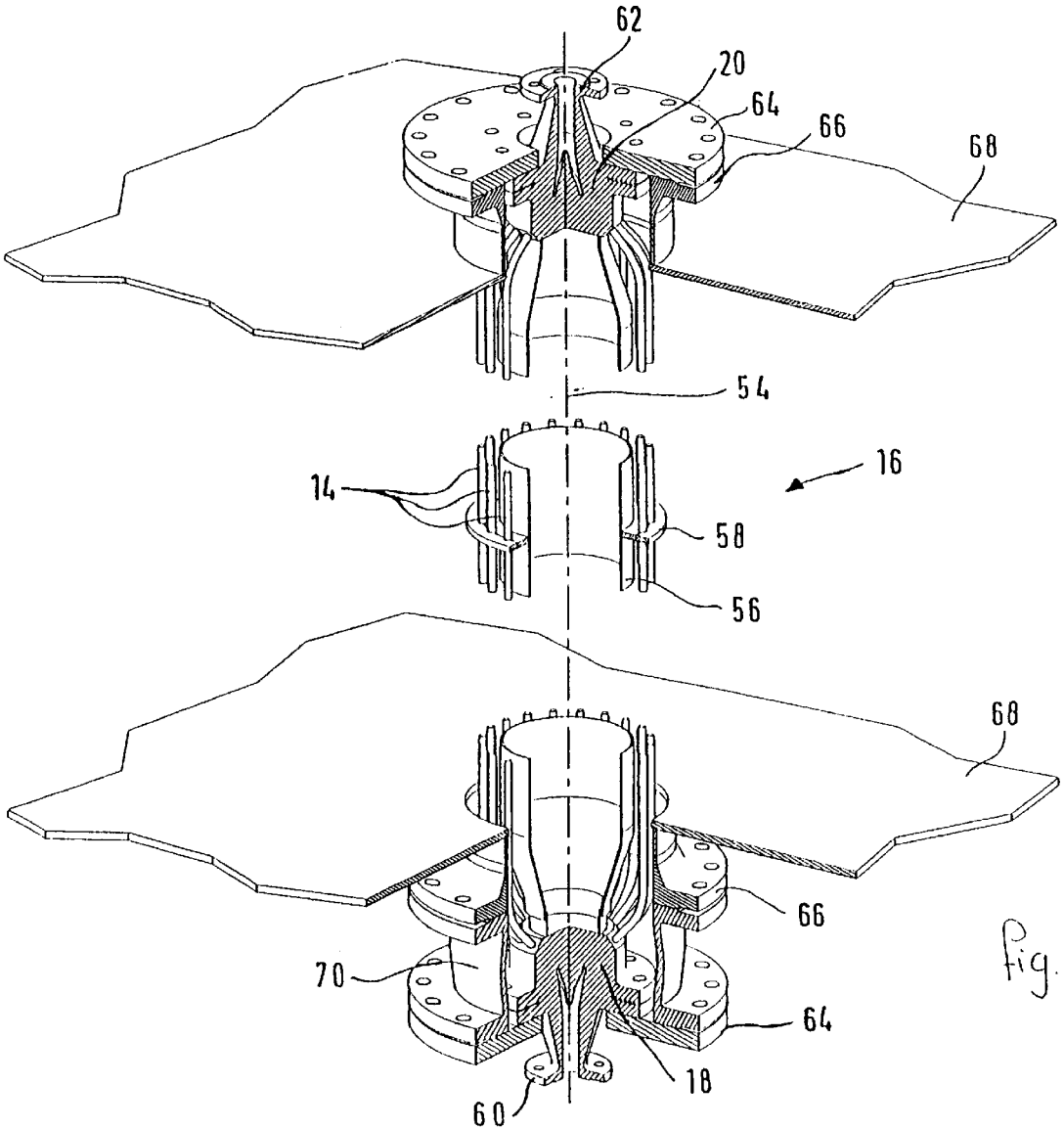
Figure 4:
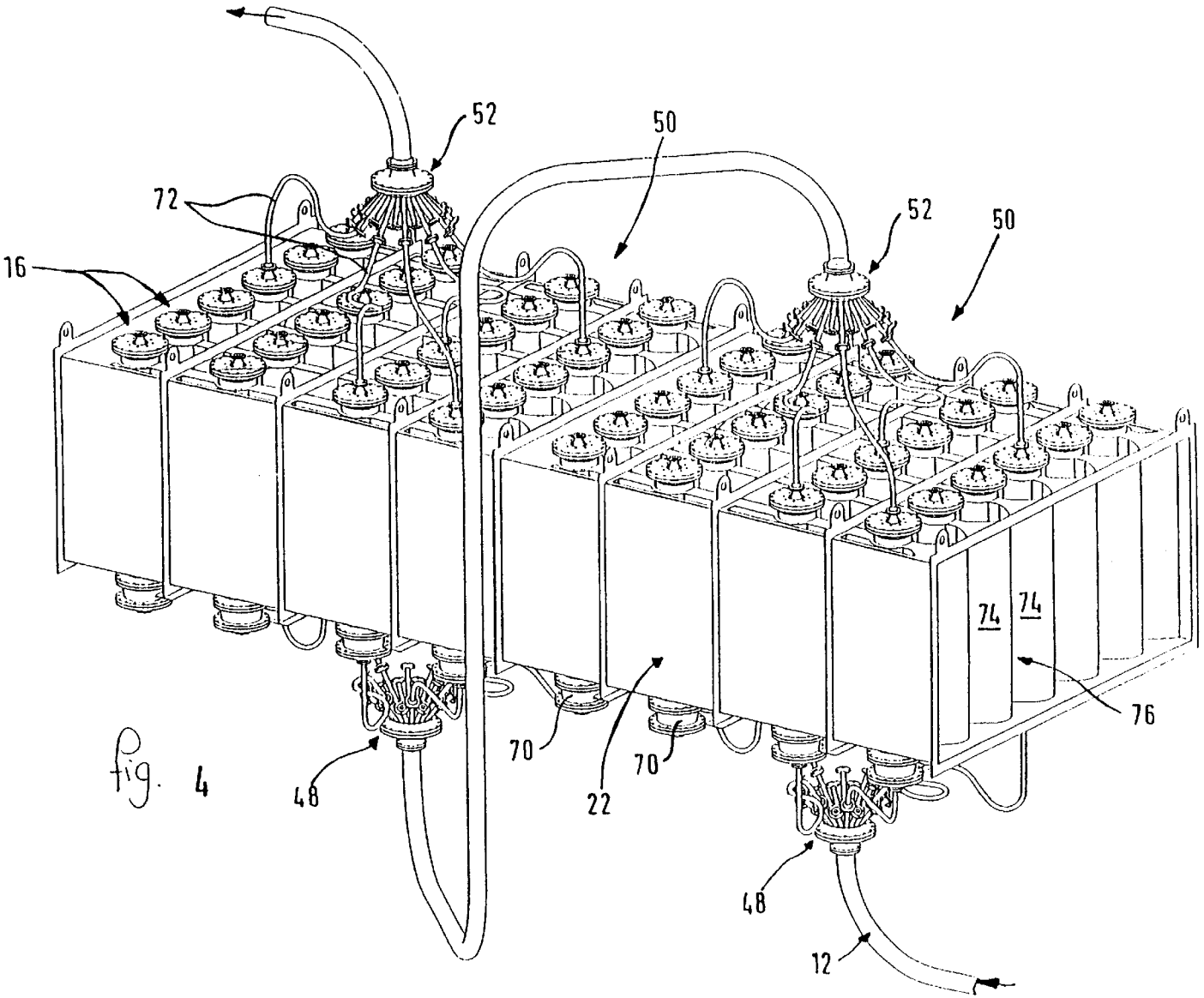
Figure 5:
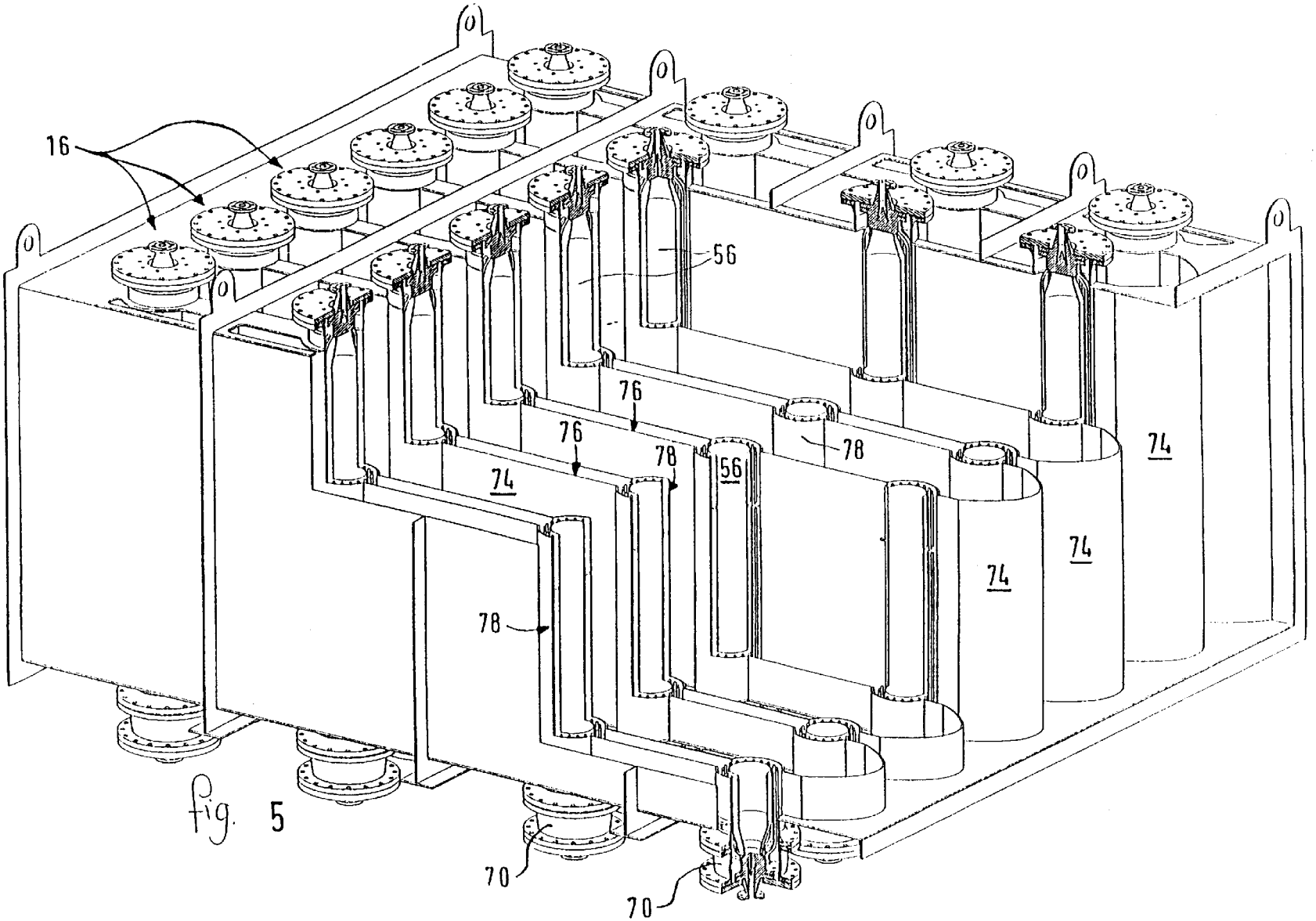

FIG. 1: shows the schematic construction of a first embodiment of a device according to the invention for injection of reducing agent into a shaft furnace;

FIG. 2: the schematic construction of a second embodiment of a device according to the invention;

FIG. 3: (in partial section) an embodiment of a heat-exchanger nest;

FIG. 4: a heating chamber containing several heat-exchanger nests, which are connected to each other to form heat-exchanger groups;

FIG. 5: a partially sectional elevation of a section from FIG. 4.

Figure 6:
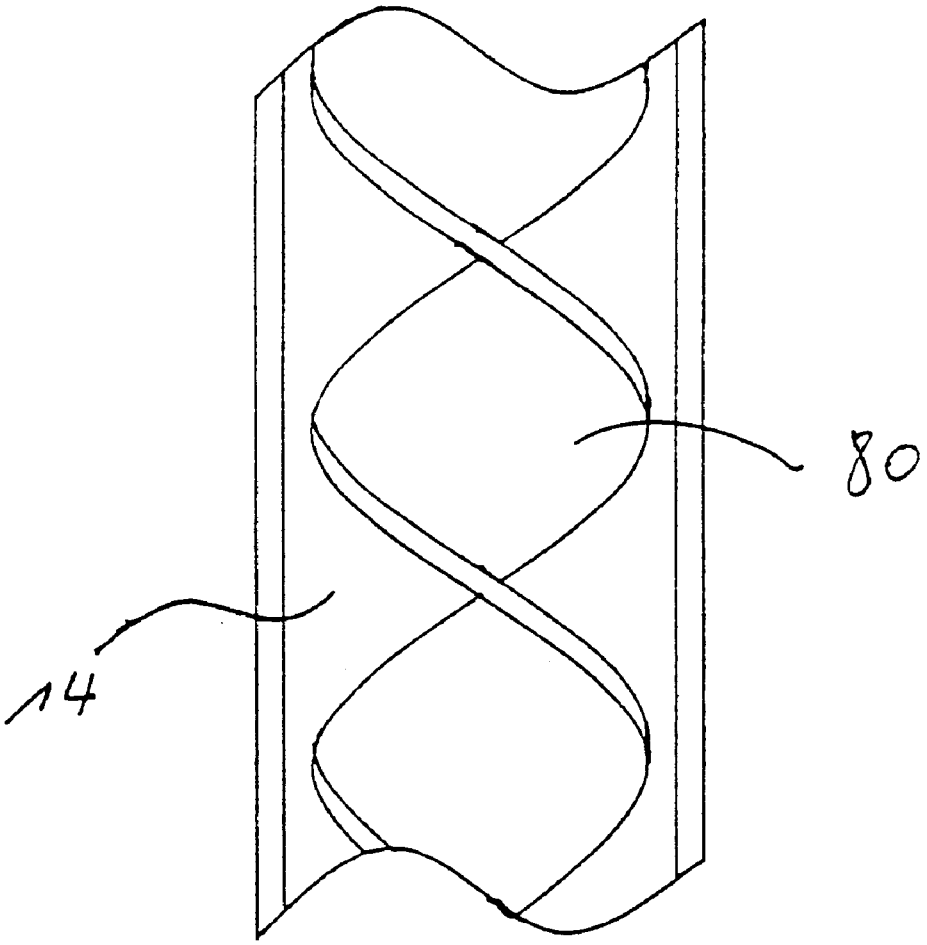

FIG. 6: a section through a heat-exchanger tube with a swirler arranged inside.

DETAILED DESCRIPTION OF PREFERRED EMBODIMENTS OF THE INVENTION

A first embodiment of a device according to the invention for injection of reducing agent into a shaft furnace is shown in FIG. 1. It comprises a pressure tank 10, into which the reducing agent is transferred before the injection, as well as several conveying lines 12, through which the reducing agent is conveyed pneumatically by a conveying gas to injection lances (not shown) on the shaft furnace.

Several heat-exchanger tubes 14 in a parallel configuration, which divide the conveying flow into several partial flows, are integrated in each conveying line 12. The heat-exchanger tubes 14 are preferably combined to form heat-exchanger nests 16, in which the heat-exchanger tubes 14 are mounted a certain distance from each other, the heat-exchanger nest 16 having on its inlet side a distributor 18 for uniform apportionment of an incoming conveying flow to the individual heat-exchanger tubes 14 and on its outlet side a collector 20 to bring together the individual partial flows to form an outlet flow. The heat-exchanger nests 16 are arranged in a heating chamber 22, in which a hot gas, which flows around the heat-exchanger nest 16, is produced by means of a furnace 24. The heat present in the hot gas is emitted to the individual partial flows in the heat-exchanger tubes 14 and the reducing agent conveyed therein is heated. Alternatively the heat carrier may also comprise a liquid or condensing medium.

In the embodiment described several heat-exchanger nests are connected in series. In this way a particularly compact arrangement can be achieved. The partial flows of reducing agent/conveying gas mixture are brought together behind each heat-exchanger nest and different temperature increases occurring in the individual tubes compensated. The failure of individual tubes does not significantly impair the serviceability and exchange capacity of the entire equipment.

The heat-exchanger nests 16 are advantageously arranged essentially vertically in each case and are traversed by the partial flows from the bottom upwards. Consequently deposits with local overheating of the tubes are avoided, the tube cross-section is exposed to a uniform flow in each case and the heat transfer from the tube wall to the reducing agent/conveying gas mixture optimised.

The hot gas is preferably produced in a combustion chamber 26 of the heating chamber 24 and conducted in the cross flow between the heat-exchanger tubes 14 (indicated by the arrow 28). After the hot gas has given up a large proportion of its heat to the different partial flows, the cooled hot gas is removed via a waste gas line 30. The hot gas is produced advantageously by combustion of lean gas, e.g. blast furnace gas, with fresh air, which is fed via a gas supply 32 or fresh air supply 34 to the furnace 24. Consequently unfavourably high combustion temperatures, which would necessitate precooling of the hot gas before entry into the heating chamber 22 during normal operation, are avoided. The high waste gas temperature prevailing behind the heating chamber 22 during operation with a high mean temperature gradient of hot gas to reducing agent/conveying gas mixture does not constitute a significant economic loss if there is no further utilisation of the residual heat of the waste gas.

If the heat-exchanger tubes 14 do not yet admit reducing agent/conveying gas mixture, e.g. when starting up the hot gas side, the hot gas can be brought to a lower temperature by a cold air supply 36 behind the furnace, thereby protecting the heat-exchanger tubes 14 against overheating. The waste gas in the waste gas line 30 can be cooled to a permissible discharge temperature in exactly the same way by admixing cold air via a cold air supply 38, if the device is operated with a high mean temperature gradient of hot gas to reducing agent/conveying gas mixture and the waste gas is to be discharged directly into the environment without further utilisation of the residual heat after leaving the heat-exchanger.

A bypass line 40, which terminates in the conveying line 12 behind the heat-exchanger nests 16 when viewed in the direction of the conveying flow, is provided for each conveying line 12. This permits maintenance of conveyance, if the heat-exchanger fails or heating is dispensed with. The change-over between the heat-exchanger nests 16 and the bypass line 40 can be effected gradually and smoothly by the use of solid mass flow control valves 42 with minimisation of the risk of line blockages.

The control of the mass flow of the reducing agent/conveying gas mixture through the heat-exchanger nests 16 by the solid mass flow control valves can additionally be used advantageously for efficient temperature control of the conveying flow. If several reducing agent/conveying gas mixtures are heated in parallel, as described, whereby the entire hot gas supply emanates from one furnace, different heating temperatures can be established in the individual solid/conveying gas mixtures with the aid of the solid mass flow control valves.

FIG. 2 shows another embodiment of the device according to the invention. This is a type of construction with only one conveying line 12, in which the reducing agent/conveying gas flow is apportioned directly at the shaft furnace by a distributor 44 to different injection lines 46 and is led through these lines to the individual injection lances. In such a device, in which the conveying line 12 logically has a large cross-section, the conveying flow can be subdivided into several partial flows in several stages. The conveying flow is apportioned for example, via pre-distributors 48 to several heat-exchanger nests 16. The device accordingly comprises several heat-exchanger nests 16, which are integrated in the conveying line 12 in a parallel configuration. The heat-exchanger nests 16 are preferably assembled a certain distance from each other to form a heat-exchanger group 50, the heat-exchanger group 50 having on its inlet side a pre-distributor 48 for uniform apportionment of an incoming conveying flow to the individual heat-exchanger nests 16 and on its outlet side an additional collector 52 to bring together the individual partial flows to form a common outlet flow.

Several heat-exchanger groups are preferably connected in series also with this embodiment. The reducing agent/conveying gas mixture partial flows are brought together behind each heat-exchanger group, and different temperature increases possibly occurring in the individual tube nests are compensated. The failure of individual tube nests does not significantly impair the serviceability and exchange capacity of the entire equipment. In addition, individual nests can be taken out of service for maintenance or shutdown, as long as shut-off valves are provided.

It should be noted that the connections of the heat-exchanger nests 16 or heat-exchanger groups 50 to each other and the connections from the heat-exchanger nests 16 to the pre-distributors 48, 52 are designed in such a way that thermal expansions can be compensated. This can be achieved, for example, by design of the connections as hoses.

FIG. 3 shows a section through the heat-exchanger nest 16. It comprises several heat-exchanger tubes 14, which extend at a certain distance from each other. The heat-exchanger tubes 14 are advantageously arranged in circular form around a longitudinal axis 54 of the heat-exchanger nest 16, a coaxial guide tube 56 at a short distance from the heat-exchanger tubes 14 being arranged in the centre between the heat-exchanger tubes 14. This guide tube 56 diverts the lateral hot gas inflow and conducts it past the individual heat-exchanger tubes 14, so that an effective hot gas inflow to the heat-exchanger tubes 14 takes place. In addition at least one assembly ring 58, which holds the heat-exchanger tubes 14 in their respective position, can be mounted on the guide tube 56. This assembly ring 58 advantageously extends outwards over half the length of the guide tube 56 and has holes through which the individual heat-exchanger tubes 14 pass.

At their respective ends the heat-exchanger tubes 14 are connected to a distributor 18 and a collector 20. The distributor 18 apportions the conveying flow arriving at an inlet flange 60 uniformly into different partial flows, each of which is guided into one of the heat-exchanger tubes 14. After passing through the heat-exchanger tubes 14 the individual partial flows are brought together again to form a common conveying flow in the collector 20 and transferred into the connected conveying line at an outlet flange 62.

It should be noted that the different heat-exchanger tubes 14 preferably have the same cross-section and the same length, so that the individual partial flows and thus the flow rates of the partial flows are largely identical in the respective heat-exchanger tubes 14. Substantial deviations in the temperature increases between the individual partial flows can be avoided in this way.

The distributor 18 and the collector 20 are preferably of identical construction, so that the heat-exchanger nest 16 is symmetrical with regard to a plane at right angles to the conveying direction. The heat-exchanger nest 16 accordingly has no preferred direction of installation and is consequently an easily assembled, standardised unit, which permits rapid exchange of blocked heat-exchanger nests 16.

The heat-exchanger nests 16 are preferably assembled in the heating chamber 22 by means of flanges 64, which are mounted on the distributor 18 and collector 20 and are bolted with suitable flanges 66 on the casing wall 68 of the heating chamber 22. A compensator 70 for equalisation of the thermally induced material expansion is incorporated at least on one side.

The arrangement of the heat-exchanger nests 16 in the heating chamber 22 is described in more detail on the basis of FIGS. 4 and 5. FIG. 4 shows a heating chamber 22 with several heat-exchanger nests 16 arranged therein, which are connected together to form heat-exchanger groups 50, and FIG. 5 a partial section.

The different heat-exchanger nests 16 of the heat-exchanger groups 50 are arranged essentially in parallel with each other and next to each other in several rows in the direction of flow of the hot gas. In the type of construction described a heat-exchanger group 50 comprises six rows each with four heat-exchanger nests 16. The heat-exchanger nests 16 are mounted with their flanges 64 on the corresponding flanges 66 of the upper or lower heating chamber wall.

For the purpose of clarity only a few of the connecting lines 72 between pre-distributor 48 or collector 52 and heat-exchanger nests 16 are marked in FIG. 4. The connecting lines 72 are preferably designed as hoses to allow compensation for thermal expansion. Furthermore, all connecting lines advantageously have the same length in order to carry the same partial flows in the case of identical pressure drops in the individual lines.

Baffles 74, which guide the hot gas flow to the individual heat-exchanger nests 16 so that effective heat transfer is achieved, are preferably mounted on both sides of the rows of heat-exchanger nests inside the heating chamber 22. For this purpose the baffle plates 74 extend on both sides of a row of heat-exchanger nests 16 in such a way through the entire heat-exchanger group 50 that an inflow duct 76 running in the direction of flow of the hot gas is separated between two baffles 74 in the heating chamber 22. The baffle plates 74 preferably have widenings 78 at the height of the heat-exchanger nest 16, which extend outwards from the latter and run vertically upwards, so that each heat-exchanger nest 16 is arranged in an. essentially cylindrical receiving space, which is connected to the receiving spaces of the adjacent heat-exchanger nests 16 in a row by a straight duct section.

At the inlet and outlet of the heat-exchanger group 50 the adjacent baffles 74 of two adjacent rows are preferably brought together at an angle, so that the individual inflow ducts are widened on the inlet and outlet sides and the inflowing hot gas is consequently conducted into the inflow duct. A hot gas flow passing through the heat-exchanger group is accordingly conducted fully into the individual inflow ducts, the hot gas flow rate in the individual inflow ducts increases and the inflow of the heat-exchanger nests 16 arranged therein is optimised.

The heat-exchanger groups 50 designed in such a way advantageously form standard components, an optional number of which can be connected one behind the other according to requirements. The hot gas flowing through is transferred at the outlet of the first heat-exchanger group directly into the inlet of the second heat-exchanger group, etc.

To improve the heat transfer to the individual partial flows further, the latter are preferably made to rotate about their direction of flow, so that rearrangement of the material ensures thorough mixing of the partial flow. For this purpose one or more swirlers 80, which extend along the longitudinal axis of the heat-exchanger tube, are preferably arranged in each heat-exchanger tube 14. As shown in FIG. 6, the swirler may, for example, be a spiral metal sheet with a pitch selected in such a way that the exchange path length and the retention time of the reducing agent in the heat-exchanger tube 14 are optimised for the required heat absorption.

Reference list

10 Pressure vessel
12 Conveying line
14 Heat-exchanger tube
16 Heat-exchanger nest
18 Distributor
20 Collector
22 Heating chamber
24 Furnace
26 Combustion chamber
28 Cross flow
30 Waste gas line
32 Gas supply
34 Fresh air supply
36,38 Cold air supply
40 Bypass line
42 Mass flow control valve
44 Distributor
46 Injection line
48 Pre-distributor
50 Heat-exchanger group
52 Collector
54 Longitudinal axis
56 Guide tube
58 Assembly ring
60 Inlet flange
62 Outlet flange
64,66 Flange
68 Casing wall
70 Compensator
72 Connecting line
74 Baffle plate
76 Inflow duct
78 Widenings
80 Swirler

What is claimed is:

1. Method for injection of reducing agents into a shaft furnace, whereby reducing agent is conveyed to the shaft furnace in a pneumatic conveying flow, comprising the steps of a) subdividing a first common conveying flow of the pneumatic conveying flow into several individual partial flows of the pneumatic conveying flow, b) conducting the individual partial flows of the pneumatic conveying flow through a heating device, c) heating reducing agent in the individual partial flows of the pneumatic conveying flow inside the heating device.

2. Method according to claim 1, wherein the individual partial flows of the pneumatic conveying flow are brought together to form a second common conveying flow of the pneumatic conveying flow after the heating of the reducing agent to homogenize the temperature conditions.

3. Method according to claim 1, wherein the steps a) to c) are repeated in several stages, wherein individual partial flows of respective stages are brought together to form, between successive stages of the several stages, a plurality of respective post stage common conveying flows in the pneumatic conveying flow for homogenization of the temperature conditions.

4. Method according to claim 1, characterized in that least one of the individual partial flows is made to rotate about its direction of flow.

5. Method according to claim 1, wherein cold reducing agent is fed to the pneumatic conveying flow for temperature control of the reducing agent before injection into the shaft furnace.

6. Device for injection of reducing agent into a shaft furnace, with a conveying line for pneumatic conveyance of the reducing agent to the shaft furnace, characterised by several heat-exchanger tubes, which are integrated in the conveying line in a parallel configuration, so that the pneumatic conveying flow is divided into several partial flows, and-by a heating device for transfer of thermal energy to the individual partial flows.

7. Device according to claim 6, characterised in that the heating device comprises a heating chamber, which can admit a heat carrier, the heat-exchanger tubes extending at least partially through the heating chamber.

8. Device according to claim 6, characterised in that the heat-exchanger tubes are arranged essentially vertically and are traversed by the partial flows from the bottom upwards.

9. Device according to claim 6, characterised in that a swirler, which causes the partial flow passing through the respective heat-exchanger tube to rotate about its direction of flow, is arranged in one or more heat-exchanger tubes.

10. Device according to claim 9, characterised in that the swirler comprises a spiral metal strip, which extends in an axial direction inside the heat-exchanger tube.

11. Device according to claim 6, characterised in that the heat-exchanger tubes are assembled a certain distance from each other to form a heat-exchanger nest, the latter having on its inlet side a distributor for uniform apportionment of an incoming conveying flow to the individual heat-exchanger tubes and on its outlet side a collector for bringing together the individual partial flows to form an outlet flow.

12. Device according to claim 11, characterised by several heat-exchanger nests, the latter being arranged behind each other in a series connection.

13. Device according to claim 11, characterised by several heat-exchanger nests, the latter being assembled a certain distance from each other to form a heat-exchanger group and the said group having on its inlet side a pre-distributor for uniform apportionment of an incoming conveying flow to the individual heat-exchanger nests and on its outlet side an additional collector for bringing together the individual partial flows to form an outlet flow.

14. Device according to claim 13, characterised by several heat-exchanger groups, the latter being arranged behind each other in a series connection.

15. Device according to claim 7, characterised by guide vanes, which are arranged inside the heating chamber in such a way that an effective inflow to the heat-exchanger tubes by the heat carrier takes place.

16. Device according to claim 6, characterised by a bypass line, which terminates in the conveying line behind the heat-exchanger tubes when viewed in the direction of the conveying flow.

17. Device according to claim 6, characterised in that the heat carrier comprises a hot gas.

18. Device according to claim 6, characterised in that the heat carrier comprises a liquid medium.

19. Device according to claim 6, characterised in that the heat carrier comprises a condensing medium.

20. Device for injection of reducing agent into a shaft furnace, with a conveying line for pneumatic conveyance of the reducing agent to the shaft furnace, said device further comprising, means for subdividing a conveying flow of said reducing agent into partial flows;

a heating device, and heat-exchanger tubes for receiving said partial flows and for conducting said partial flows through said heating device, said heat-exchanger tubes being integrated in the conveying line in a parallel configuration, such that individual partial flows receive thermal energy transferred by said heating device.

21. Device according to claim 6, wherein a swirler is arranged in one or more heat-exchanger tubes, said swirler causing the partial flow passing through a respective heat-exchanger tube to rotate about its direction of flow.

22. Device according to claim 20, wherein the heat-exchanger tubes are assembled a certain distance from each other to form a heat-exchanger bundle, said heat-exchanger bundle having on its inlet side a distributor for uniform apportionment of an incoming conveying flow to the individual heat-exchanger tubes and on its outlet side a collector for bringing together the individual partial flows to form an outlet flow.

23. Device according to claim 22, comprising several heat-exchanger bundles, said heat-exchanger bundles being arranged behind each other in a series connection.

24. Device according to claim 22, comprising several heat-exchanger bundles, said heat-exchanger bundles being assembled a certian distance from each other to form a heat-exchanger group and the said group having on its inlet side a pre-distributor for uniform apportionment of an incoming conveying flow to the individual heat-exchanger bundles and on its outlet side an additional collector for bringing together the individual partial flows to form an outlet flow.

* * * * *